United States Patent [19]

Fiocca

[11] 4,065,673

[45] Dec. 27, 1977

[54] ROTOR CONTROLLER SYSTEMS FOR X-RAY TUBES

[75] Inventor: Louis L. Fiocca, Bensenville, Ill.

[73] Assignee: Advanced Instrument Development, Inc., Melrose Park, Ill.

[21] Appl. No.: 601,647

[22] Filed: Aug. 4, 1975

[51] Int. Cl.[2] ..... H05G 1/70

[52] U.S. Cl. ..... 250/402; 250/406

[58] Field of Search ..... 250/401, 402, 406, 407; 313/60

[56] References Cited

U.S. PATENT DOCUMENTS

| | | | |
|---|---|---|---|
| 3,205,360 | 9/1965 | Graves | 250/406 |
| 3,335,280 | 8/1967 | Wright | 250/406 |
| 3,409,775 | 11/1968 | Mahler | 250/407 |
| 3,641,408 | 2/1972 | Fiocca | 250/406 |

*Primary Examiner*—Craig E. Church
*Attorney, Agent, or Firm*—Leo J. Aubel

[57] ABSTRACT

A system for controlling the operation of the starter for X-ray tubes and more specifically the acceleration and operation of the rotating anodes of the X-ray tubes in accordance with any one of several X-ray exposure functions to be performed. The system includes D.C. braking controls, means to prevent X-ray exposure during the acceleration and deceleration periods, and means for assuring that one operating sequence is terminated before a succeeding operating sequence is initiated.

7 Claims, 9 Drawing Figures

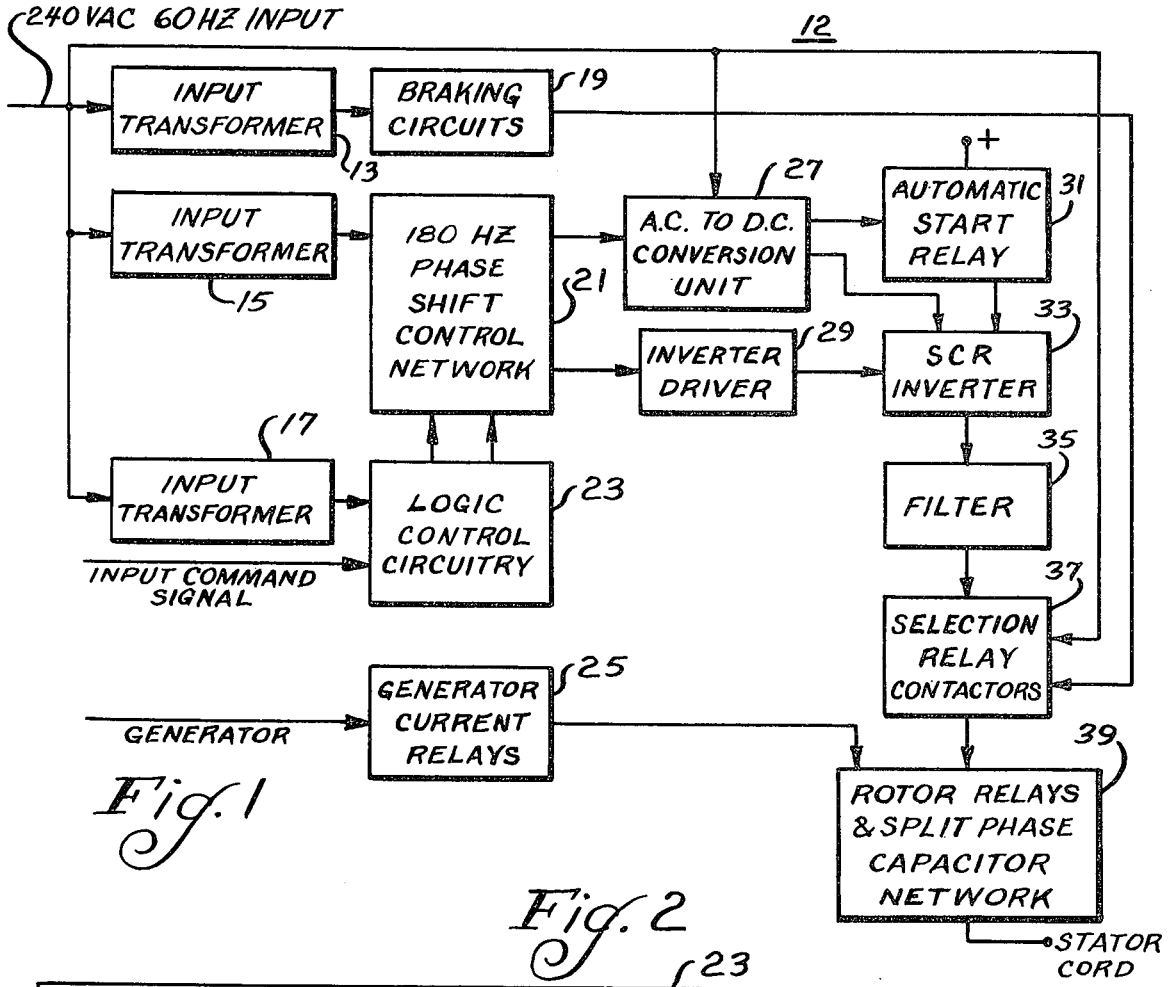
Fig. 1
Fig. 2
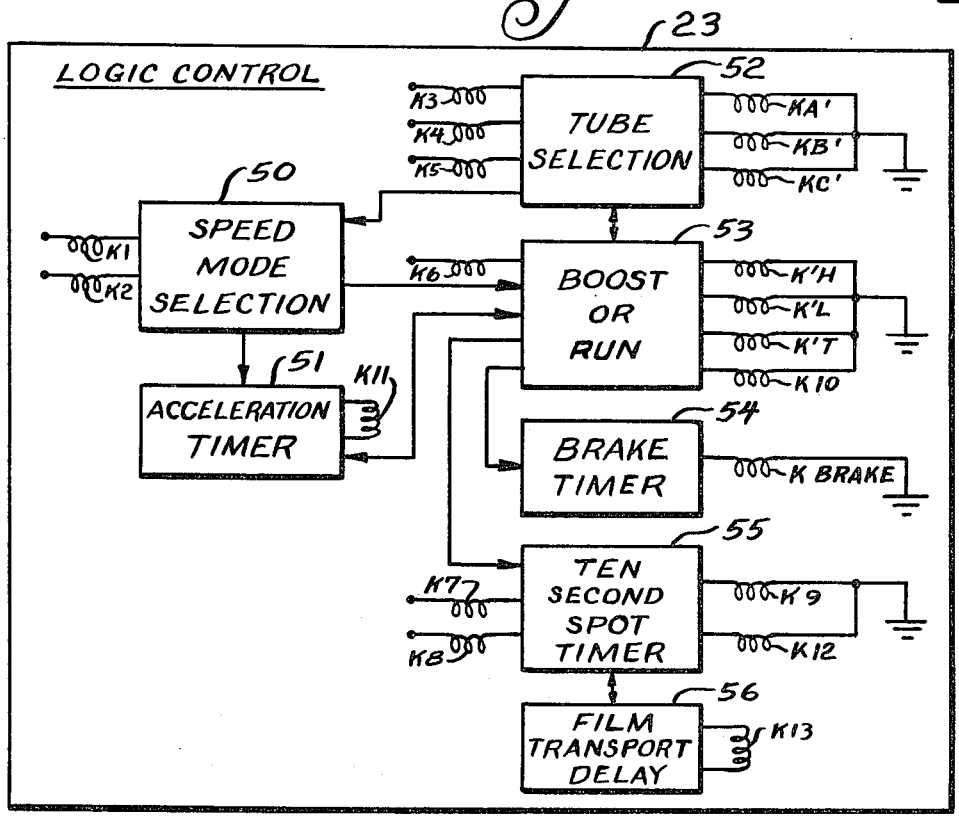

STATOR COIL
INVERTER GATE DRIVE
INVERTER GATE DRIVE
COMMON
AMPLIFIERS
DIFFERENTIATOR
FLIP FLOP
360 HZ OSC
240V AC
GATE DRIVE TO UNIT 27
COMMON
+25 V
TO GENERATOR
COMMON
COMMON

ROTOR CONTROLLER SYSTEMS FOR X-RAY TUBES

BACKGROUND OF THE INVENTION

The present invention relates to U.S. Pat. No. Re 28,168 entitled "SOLID-STATE POWER SUPPLY SYSTEM FOR ROTATING ANODE X-RAY TUBES," and to U.S. patent application, Ser. No. 516,752, entitled "VARIABLE SPEED STARTERS FOR X-RAY TUBES," both in the name of Louis L. Fiocca and both assigned to the same assignee as the present invention. For purposes of simplification of the description of the circuitry in this application, reference as appropriate is herein made to said U.S. Pat. No. Re 28,168 and to said patent application, Ser. No. 516,752, now U.S. Pat. No. 3,968,413.

The control system of the present invention provides a means of controlling the starter and drive system for the anode of the associated X-Ray tubes. The rotors of the associated tubes are selectively controlled to accelerate or boost the rotor to a relatively low running speed, and to a second relatively high running speed, and either of the selected running speeds can be varied within a given operating range. Further, a selected braking sequence is provided to decelerate or brake the rotating anode dependent on the running speed.

An X-Ray examination room will conventionally have at least two X-ray tubes; one of the tubes is normally used for doing fluoroscopic examinations and the other tube is normally used for doing radiographic exposures. For doing such fluoroscopic examinations, the undertable tube is operated at a relatively low speed. In contrast, radiographic exposures are preferably done at high speeds, say at 10,800 RPM, and therefore the rotating speed of the overtable tube must be boosted to a high running speed. The present invention provides a control system for a starter and drive means for accelerating and operating the rotating anodes of one or more tubes of an X-Ray examination room at the required operating speeds.

A portion of the circuitry of the present invention is the same as that described in the U.S. Pat. No. Re 28,168, and reference is specifically made to that patent as needed to amplify the description of the present invention.

The rotor controller system of the invention provides fast acceleration of the X-Ray tube anodes for a selected one of three separate tubes which tubes may be of differing voltage and current ratings. It is desired that these tubes be accelerated to the running speed in a minimum of time.

The system provides a direct current dynamic braking circuit which controllably decelerates the X-Ray tube anode from its running speed to less than a few hundred RPM's. The foregoing increases bearing life and minimizes tube breakage by causing the rotor to pass quickly through its resonant frequency vibration modes as it is decelerated.

The foregoing and other objects, features and advantages of the invention will be apparent from the following more particular description of the preferred embodiments of the invention, as illustrated in the accompanying drawings wherein:

DESCRIPTION OF THE DRAWINGS

FIG. 1 is a block diagram showing an X-Ray rotor controller system in accordance with the invention;

FIG. 2 is a block diagram showing additional details of the logic control circuitry of FIG. 1;

DESCRIPTION OF THE INVENTION

Figure 3:
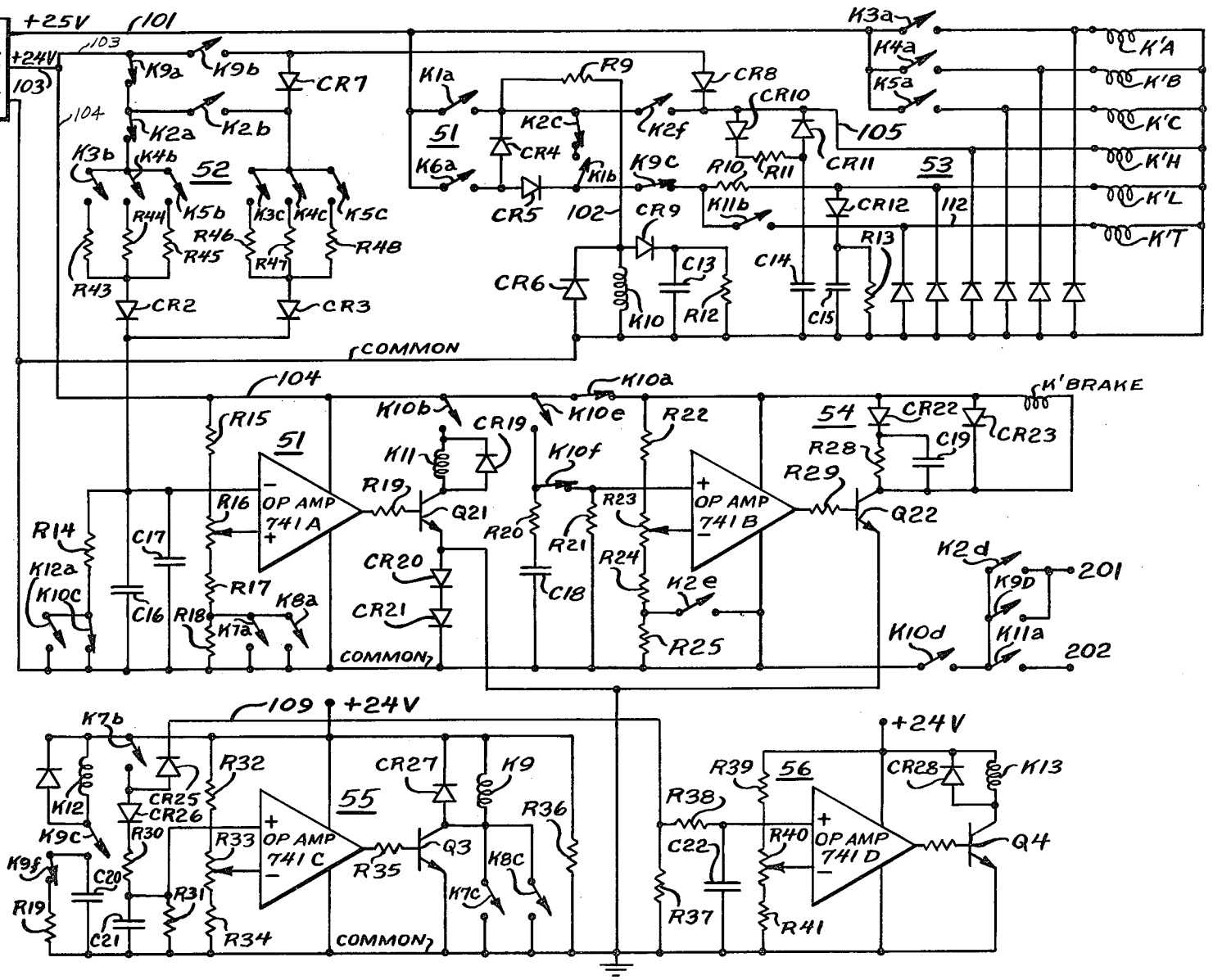
FIG. 3 is a circuit diagram showing the structural detail of the blocks shown in FIG. 2.
Figure 4:
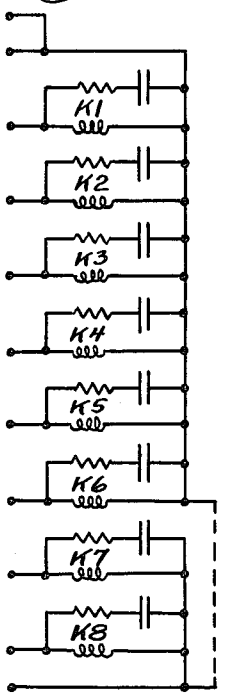
FIG. 4 shows the circuits for energizing the relays utilized in FIG. 3.

The system of the invention is arranged to selectively control the operation of one or more X-Ray tube rotor anodes; each of which tubes may be of different ratings utilizing different input voltages and current. In a preferred embodiment the system controls an SO or "over the table tube," used for doing radiographic examinations; an SU or "under the table tube," used for doing fluoroscopic examinations; and, an SA or "auxiliary tube".

In the preferred embodiment, the tube to be operated is manually selected by actuating an appropriate button on a control panel. Suitable circuitry, as will be explained with reference to FIG. 3 hereinafter, and specifically, the proper resistors for a proper operation of the selected X-Ray tube are thus selected. In the particular embodiment shown, the system is arranged for use with X-Ray tubes designated as the Maxiray 75, the Maxiray 100 or the Maxiray 125, manufactured by General Electric Co.

To start operation, the operator presses a button on an X-Ray hand control switch which initiates operation of the circuit as will be explained.

In the following description the various biasing, coupling and output resistors, diodes and capacitors, which are common and well known, will not be described in detail to thus avoid needlessly burdening the more meaningful description of the operation of the inventive system.

Refer now to FIG. 1 which shows the rotor controller system 12 of the present invention. The various blocks of FIG. 1 will be described generally at first, then a more detailed description will be made.

In operation, a 240 volt A.C. 60 Hz. input voltage is applied to input transformers 13, 15 and 17; to an A.C. — to — D.C. Conversion Unit 27; and, to the selection relay contactors 37. Transformer 13 provides an input voltage to braking circuits 19; transformer 15 provides an input voltage to a 180 Hz. phase shift control network 21; and transformer 17 provides an input voltage to a logic control circuitry 23. As mentioned above, a portion of the circuitry comprising various blocks of system 12 is generally similar to the circuitry of U.S. pat. No. Re 28,168; however, a basic difference of the system 12 of FIG. 1 and U.S. Pat. No. Re 28,168 is that the Reissue Patent utilizes a high speed starter circuit and an entirely separate low speed starter circuit, while the present invention utilizes a single starter circuit. In this latter feature, the present invention is similar to the structure of patent application, Ser. No. 516,752; that is, the present invention utilizes a single starter for performing high speed acceleration or boost and low speed boost to the associated anode rotor.

As described in U.S. Pat. No. Re 28,168 and in patent application, Ser. No. 516,752, phase shift control network 21 develops a 180 Hz. phase shifted signal which is supplied through an inverter driver 29 to an SCR inverter 33 to develop a 180 Hz. square wave output signal. A sinusoidal OTT filer 35 receives the square wave output from SCR inverter 33 and delivers a 180 Hz. sine wave signal to selection relay contactors 37, and then through rotor relays and split phase capacitor network 39 to the stator terminals or cords of the drive motor for the X-Ray anode rotor to thereby provide the rotor with a synchronous driving power.

The selection relay contactors 37 also receive an input from full wave D.C. braking circuits 19 which provide a selective D.C. signal comprising a rectified pulsating signal to provide a braking action to the anode rotor as desired.

The phase shift control network 21 includes an SCR (silicon controlled rectifier) circuit including a pair of SCRs, each of which, when gated or trigger to conduction, will conduct for the remainder of the half cycle of the A.C. (alternating current) wave provided to the anode-to-cathode current path of the SCR. Thus, dependent on the point at which an SCR is triggered to conduction, relative to the phase angle of the applied A.C. wave, that SCR will conduct current for a selected controllable time period. By utilizing such phase control, the circuit of FIG. 1 provides a means for controllably operating the rotors of associated X-Ray tubes at a selected accelerating or boosted voltage condition, at the selected running speed, or for maintaining the rotor in its quiescent condition.

Logic control circuitry 23 of FIG. 1 determines the amount of phase shift to be provided by phase control network 21 which thereby develops a signal to control the amplitude of the output signals from an A.C. — to — D.C. Conversion Unit 27.

The A.C. — to — D.C. Conversion Unit 27, which comprises a full wave SCR bridge circuit, provides a D.C. driving signal which is coupled to the SCR inverter 33. Dependent on the input signal from the logic control circuitry 23, the output provided by Conversion Unit 27 can be 0° to 180° out of phase with the input to the A.C. — to — D.C. Conversion Unit 27 from the 240 VAC 60 Hz. input.

As will be described further hereinbelow with reference to FIG. 9, and as described in the aforesaid Reissue Patent, when the phase shift provided by phase shift control network 21 is zero degrees, the firing angles of the A.C. — to — D.C. Conversion Unit 27 is such as to allow nearly 180° of conduction of each of the SCR's. This is the boosted condition and will allow maximum current flow to charge the output capcitor associated with the Conversion Unit 27, and, the charge on the output capcitor provides an increased D.C. voltage which increased or boosted voltage constitutes a supply voltage for the inverter 33. The inverter 33 is a free running inverter commutated by a capacitor in a circuit which drives the primary winding of a transformer whose output in turn powers the stator of the anode rotor.

In the run condition of the rotor, a phase shift is provided to the Conversion Unit 27 such that the firing angle of the SCR's is less than 0°, and in this condition, the charge on the associated capacitors is a reduced D.C. voltage and the inverter 33 operates at this reduced level.

The phase shifted signal provided by the network 21 thus controls the drive to the anode rotor from an idle condition, to a low speed operation, to a maximum acceleration and to a high speed operation, as will be explained.

As mentioned above, in a preferred embodiment of the inventive system, the logic control circuitry, block 23 of FIG. 1, shown in more detail in FIG. 2 is arranged to control three separate X-Ray tube anode rotors. The selection of which of the X-ray tubes is to be operated is made by energizing the respective associated relay K3, K4 or K5 such as by control buttons on a suitable panel; this feature is indicated in FIG. 2 by the tube selection block 52. Since each of the tubes may be of different ratings utilizing different input voltages and currents, activation of the selected relays connects into the circuitry suitable resistors (as will be explained with reference to FIG. 3) which are selected or programmed for the appropriate X-Ray tube.

Prior to initiating operation, a second selection to be made is that of selecting the speed at which the anode rotor of the selected tube is to run for a desired type of exposure. Relay K2 is the speed selection relay. With relay K2 de-energized the anode rotor will be operated at a low speed, that is, at about 3,600 RPM and when K2 is energized, the tube will operate at a high speed; that is about 10,800 RPM. Block 50 indicates the speed mode selection.

Operation of the system is initiated by activating the button of a manual switch (not shown) which causes relay K1 to be energized to thereby couple operating current to the system of FIGS. 1 and 2.

The boost or run block 53 shown in FIG. 2 controls the acceleration and operating mode of the anode rotor. As will be explained with reference to FIG. 3, the circuitry of the boost or run block 53 provides a means for controlling the amount of total time the anode rotor is accelerated to attain its selected rate of speed.

The brake timer block 54 provides circuitry for selectively connecting a D.C. braking voltage to decelerate the anode rotor.

The system also provides circuitry for accommodating spot film operation as selected by the operator, wherein up to four spot film exposures are taken in sequence. More specifically a ten second spot timer 55 provides a delay circuit for continuing the rotating speed of the rotor for ten seconds after the last spot film is made so that the anode rotor speed is maintained at the desired totaling speed in the interval between spot film exposure and the succeeding exposure.

Another feature of the invention comprises the film transport delay block 56 which provides a means of delaying the X-Ray exposures in the spot film operating mode for a selected time interval after the film transport delay or casette carrier, that is, the unit carring the X-Ray film is positioned in place. This tends to assure that vibrations due to movement and placement of the film transport have ceased before the spot film X-Ray exposure is made.

As mentioned, the SO, SU and SA X-Ray tubes are each controlled for either a low speed or a high speed operation. The tubes to be controlled have different characteristics and these characteristics are taken into consideration in the present system to provide the specific boost voltage and timing of such boost voltage to obtain proper operation.

Refer now to FIG. 3. The logic control circuitry of FIG. 3 includes a number of relays which are actuated to provide the desired function as will be explained. The logic control circuitry of FIG. 3 energizes or de-energizes the relay coils to selectively open and close contacts of the relays to connect proper circuitry and proper circuit voltages to power the stators of the associated tubes. The relay and relay coils are referenced by the designation K plus a number; thus relay K1. And, the associated relay contacts are designated by the relay designation plus a letter reference; thus, relay contact K1*a*. Further, in the drawing the relay contacts are shown in an unenergized condition, and as is well known, in the energized condition, the contacts will change states, that is, if a relay contact is initially closed it will open when the relay is energized and if the contact is initially open it will close. Thus, one of the relays K3, K4 or K5 is energized when the tube to be operated is selected, and the respective one of the contacts K3*a*, K4*a* and K5*a* is closed to close the stator of the selected tube.

Then, when relay K1 is energized, contacts K1*a* and K1*b* are closed to complete the current path from a conventional A.C. bridge power supply 100 through lead 101, relay contacts K1*a*, K2*c*, K1*b* and K9*c* and resistor R10 to energize the coil of low speed operation relay K'L to initiate low speed operation of the anode rotor of the selected tube. Concurrently, a path is closed to energize relay coil K10 through the current path which may be traced from the power supply 100 through lead 101, contact K1*a*, resistor R9, lead 102 and relay coil K10 to the common lead to activate the boost circuit, as will be explained, to accelerate the anode rotor.

Assume for description purposes that "over the table" tube SO is to be operated, and relay K3 is energized. Also, as mentioned a second selection is made to determine the operating speed of the anode rotor required. Assume low speed operation, that is, relay K2 is not energized. Also note that the source of supply 100 is connected through normally closed contacts K9*a*, K2*a*, contact K3*b* through resistor R43 and diode CR2 to the charging capacitors C16 and C17 of acceleration timer 51 which capacitors are connected in parallel to one another. When relay K10 is energized, its normally closed contact K10*c*, in acceleration timer 51 will open and disconnect the low resistance resistor R14 connected across the capacitors C16 and C17 thus permitting capacitors C16 and C17 to start to charge.

Contact K10*b* also closes to connect the relay coil K11 in a circuit path from the power supply 100 through leads 103 and 104, contact K10*b*, relay coil K11, the collector to emitter current path of transistor Q21 and diodes CR20 and CR21 to the common lead. The upper plates of capacitors C16 and C17 are connected to the negative input terminal of an operational amplifier (Op. Amp.) 741A functioning as a threshold detector. The positive input terminal of Op. Amp. 741A is connected through the adjustable arm of a resistor R16 to a voltage divider circuit consisting of resistors R15, R16, R17 and R18. Op. Amp. 741A will conduct until the charge on capacitors C16 and C17 reaches a preselected balance level determined by the setting of resistor R16. As long as Op. Amp. 741A is conducting, it will provide an output current to the base of transistor Q21 to cause transistor Q21 to tend to conduct. Transistor Q21 functions as an electronic switch to control current flow through relay coil K11 which is connected in series with the transistor Q21 collector to emitter current path circuit.

With relay coil K'L energized, the anode rotor of the selected tube K3 will now be tending to operate at a relatively slow speed. To accelerate the anode rotor to the desired slow speed within a desired short time interval, the system of the invention provides a controlled acceleration voltage to boost the speed of the rotor to the proper operating speed. Accordingly, when relay K11 is energized, contact K11*b* will be closed to energize the coils of the low speed boost/run transfer relay K'T, which is connected to the power supply 100 through a path which may be traced from lead 101, contacts K1*a*, K2*c*, K1*b*, K9*c* and K11*b* and lead 112 to relay coil K'T. Relay K'T will continue to be energized so long as contact K11*b* is closed responsive to energization of relay K11. And the relay K11 will remain energized so long as transistor Q21 has base current flowing therethrough from Op. Amp. 741A.

In turn, Op. Amp. 741A will provide a base current to transistor Q21 until the capacitors C16 and C17 are charged to a pre-determined level at which time the Op. Amp. 741A will cut off and interrupt the base current to transistor Q21 thereby switching Off the current flow through coil K11. When this occurs, contact K11*b* will open thereby interrupting current flow through relay coil K'T thereby terminating the period of acceleration. The acceleration period is pre-set and is determined principally by the RC discharge time constant of capacitors C16, C17 and resistor R14; and the setting of the adjustable arm on resistor R16.

Contact K10*c* is normally closed and thus prevents capacitors C16 and C17 from charging, and only when relay K10 is energized will contact K10*c* open to thereby allow capacitors C16 and C17 to start charging to initiate the acceleration timing period.

Relay K2 functions as the high speed selection relay. To initiate operation of the high speed mode, relay K2 is first energized by the operator, and then when relay K1 is energized, high speed operation will ensue.

When relay K2 is energized, contact K2*a* is opened and contact K2*b* is closed to thereby provide the D.C. power through line 103, contact K9*a*, contact K2*b*, selected contact K3*c*, resistor R46, diode CR3, to the capacitors C16 and C17 of the acceleration timer 51.

Also with relay K2 energized, contact K2*f* is closed thereby connecting the power supply 100 through lead 101, closed contact K1*a*, contact K2*f* through lead 105 to the high speed selection relay K'H for controlling operation of the anode rotor to the high speed mode.

The acceleration timer 51 will be activated in the same manner as described above to time the acceleration of the rotor to obtain high speed rotation.

In addition, relay contacts K2*d* and K11*a* (see right hand middle section of FIG. 3) are closed thereby completing the circuits from terminal 201 and terminal 202 to the common lead, for purposes to be explained.

Upon completion of the desired exposure, the manual switch is released thereby de-energizing coil K1, which thereupon initiates a braking operation for the anode rotor. When K1 is de-energized, contact K1*a* opens and coil K10 is de-energized. When relay coil K10 is de-energized, contact K10*a* closes and couples the power supply 100 voltage through leads 103 and 104 and contact K10a to the brake relay K'Brake. Transistor Q22 functions as an electronic switch to complete the current path which may be traced from the power supply 100 through leads 103 and 104, contact K10*a*, K'Brake, the brake relay coil and the collector to emitter path of transistor Q22 to the common lead.

During the period that relay K10 was energized, contact K10*e* was closed thereby allowing capacitor C18 to charge to a pre-selected voltage through the circuit which may be traced from the power supply 100 voltage through leads 103 and 104, contact K10*e*, resistor R20 and capacitor C18 to the common lead.

Op. Amp. 741B also functions as a threshold detector and has its positive input terminal connected to the junction of resistors, R20 and contact K10*e* through contact K10*f*, and will be rendered conductive by the voltage on capacitor C18 thereby providing a base current to transistor Q22.

When contact K10*a* closes, as described above, current flows through relay coil K'Brake through resistor Q22 to activate the braking operation and provide a D.C. braking voltage to the stator cord as will be explained with reference to FIG. 9. Transistor Q22 will continue to conduct until capacitor C18 discharges through resistors R20 and R21 to a preset level, determined by the setting of the adjustable arm of resistor R23, which arm is connected to the negative input terminal of Op. Amp. 741B. Resistor R23 is part of a voltage divider circuit comprising series connected resistors R22, R23, R24 and R25. When capacitor C18 discharges to the aforestated pre-set level, Op. Amp. 741B will cease conducting thus terminating the base current to transistor Q22, which, in turn, switches off or opens the circuit to the K'Brake relay coil. The foregoing will terminate the braking voltage applied to the anode rotor. Thus, a braking voltage is provided to energize K'Brake coil to decelerate the rotating anode for a time period determined by the discharge rate of capacitor C18 which depends on the RC time constant of capacitor C18 and resistors R20 and R21 as well as the adjustment of resistor R23 of Op. Amp. 741B.

For high speed operation, the contact K2e is provided to short out resistor R25 to therefore change the balance point of Op. Amp. 741B and lengthen the period of time for which the relay coil K'Brake is actuated and the period of time the braking voltage is applied when the rotor is operating at a high rate of speed. The braking voltage must be applied for a longer period of time when the anode rotor is in the high speed operation in order to properly decelerate the rotor, as can be readily appreciated.

The fluroscopy operation is selected by energization of relay K6. For fluoroscopy, which is normally slow speed, continuous operation, contact K6*a* is closed which connects the D.C. power supply 100 through lead 101, closed contact K6*a*, diode CR5, contact K9*c* and resistor R10 to relay coil K'L to provide slow speed operation.

The ten second spot timer 55 (lower portion of FIG. 3) provides a means of assuring that the system continues to operate at the high rate of speed for 10 seconds after a spot film exposure is made. Relay K7 functions as the spot film high speed selection relay. When relay K7 is energized, contact K7*c* is closed to energize relay coil K9. Relay K9 then closes its contact K9*b* to connect the D.C. source supply 100 through lead 103, contact K9*b*, diode CR8 and lead 105 to energize the high speed relay K'H.

Also, when contact K9*b* closes, the D.C. power supply 100 is connected through contact K9*b*, diode CR7, contact K3*c*, resistor R46 (or the other selected contact-resistor combination) and diode CR3 to charge capacitors C16 and C17 to operate the acceleration timer 51 as previously described. When relay contact K9*c* closes, capacitor C21, in the spot timer 55 charges through the path which may be traced from the power supply 100 through contact K7*b*, diode CR26, resistor R20 and capacitor C21 to the common lead.

Op. Amp. 741C also functioning as a threshold detector, will conduct to provide a base current to transistor Q3 (similarly as described above) with reference to Op. Amp. 741A thereby permitting current to continue to flow from the power supply (+24 V) through relay coil K9 and transistor Q3 to the common lead. For clarity in the drawing the +24 V point indicated for the spot timer 55 and the transport delay 100 have not been extended to power supply 100. Op. Amp. 741C will conduct until capacitor C21, which is connected to the positive input terminal of Op. Amp. 741C, discharges through resistor R31 to a pre-set balance level. The balance level is determined by the adjustable arm of resistor R33 connected to the negative input terminal of Op. Amp. 741C. Resistor 33 is connected in series to resistors R32 and R34 to provide a voltage divider network. The discharge time of capacitor C21 through resistor R31 is set for 10 seconds.

Note that contact K9*c* is closed to enable relay coil K12 to be energized. Coil K12 is energized for about 20 milliseconds to close its contact K12*a* in the acceleration timer 51 and permit capacitors C16 and C17 to be discharged to zero reference. After twenty milliseconds capacitor C20 charges and relay coil K12 is de-energized. Capacitor C20 is discharged through contact K9*f* and register R19 when relay K9 is de-energized.

Also, contact K7*a* (in acceleration timer 51) is closed thereby shorting a portion of the resistor R18 of the voltage divider circuit including resistors R15, R16, R17 and R19 thereby permitting lowering the level to which the charging capacitors C16 and C17 must be charged in order to turn off threshold detector 741A to stop base current to transistor Q21 and de-energize relay coil K11. This reduces the time length of the acceleration period. Since just prior to initiating the spot film operation, the anode rotor is already rotating at about 3,600 RPM, the rotor can be accelerated to the desired high speed operation of 10,800 RPM for spot film exposure within a shorter time than required to accelerate the rotor from zero RPM to 10,800 RPM. It follows then that for the spot film mode of operation, the acceleration or boost voltage need be provided for only a portion of the time required to accelerate from 0 to 10,800 RPM.

Cine or high speed fluoro operation is initiated by energizing relay K8. Contacts K8*a* and K8*c* are connected in parallel with contacts K7*a* and K7*c* respectively and operate similarly to reduce the acceleration time and to maintain relay coil K9 energized.

Relay K9 will be energized through contacts K7*c* or K8*c* when either the spot film high speed operation relay K7 or the fluoricon high speed (cine) relay K7 are energized.

When contact K7*b* closes the 24 volt supply is also applied through contact K7*b*, diode CR25, lead 109 and resistor R38 to charge capacitor C22 of the film transport or casette delay 56. Op. Amp. 741D, also functioning as threshold detector similarly to Op. Amo. 741C has its positive input terminal connected to capacitor C22 and its negative input terminal connected to the adjustable arm of resistor R40. Resistor R40 is part of a voltage divider circuit comprising series resistors R39, R40 and R41. The conduction level of Op. Amp. 741D is set by adjustable resistor R40 to provide a time delay from 0.6 to 1.6 seconds after the spot film relay K7 is energized before Op. Amp. 741D conducts to provide base current to transistor Q4 to permit current to flow through relay K13. This tends to assure the film transport is stationary; that is, settled down in position and not vibrating before the spot film X-Ray exposure is taken.

Figures 5, 6, 7, 8, 9:
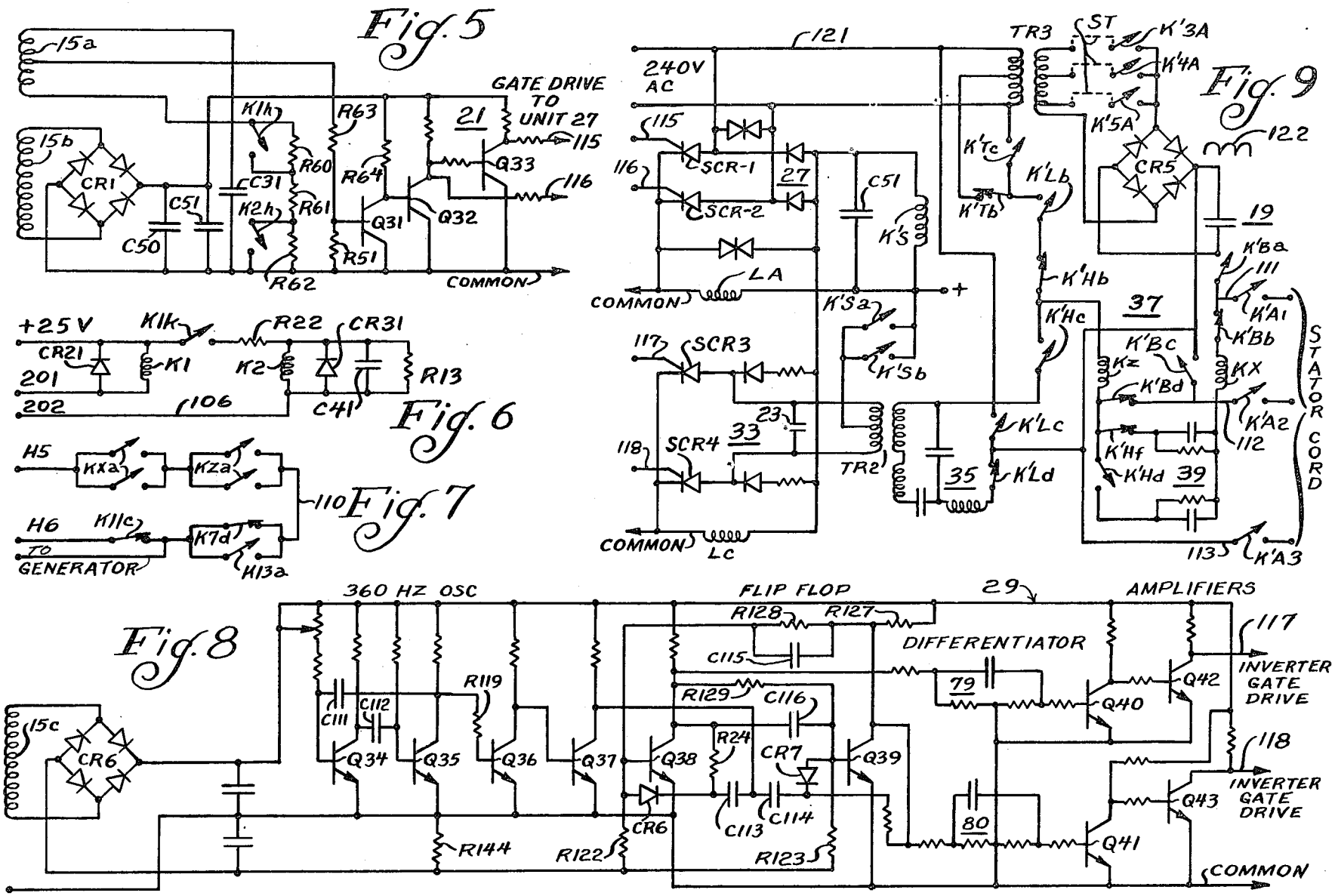
FIG. 5 is a circuit diagram of a portion of the 180 Hz. phase shift control network in FIG. 1.
FIG. 6 shows the relay energizing circuit which operates in response to the circuitry of FIG. 3 to control the operation of the circuit of FIG. 5.
FIG. 7 shows an interlock circuit showing the circuit contact connections which operate in response to the circuit of FIG. 3 to control the operation of the circuit of FIG. 9.
FIG. 8 shows an additional portion of the circuit of the 180 Hz. phase shift control network which is connected to the logic control circuit and operable in response thereto; and, FIG. 9 shows the relay circuit controlling the energizing of the current relays of the stator of the associated X-Ray tubes.

Refer now also to FIG. 7. Relay K13 (FIG. 3) when energized, closes contact K13*a*. At this point, relays KX (not shown) and KZ (not shown) are energized since current is being provided to the stator cords and accordingly contact KX*a* and KZ*a* (FIG. 7) are closed. Note that contact K11*c* is opened during the acceleration period when relay K11 is energized.

When relay K7 is energized, relay K7*d* opens. And, the interlock circuit of FIG. 7, which may be traced from the generator through parallel connected contacts K7*d* and K13*a* to terminal H5, is open. Relay K13 will maintain contact K13*a* open until it is energized as described above. That is, after the 0.6 to 1.6 second delay, contact K13*a* will close to complete the current circuit from the generator to terminal H5.

Once relay K13 pulls in, it stays energized for a relatively long time because of the long discharge time constant of capacitor C22 and resistor R37.

Each time another spot film is made by actuation of relay K7, contact K7*b* closes and capacitor C21 is recharged which maintains relay K9 energized for a 10 second period after the X-Ray exposure, i.e., the anode rotor continues operating at a high speed for a 10 second period after each exposure.

It is important throughout the circuit that no two sequences can occur simultaneously since all the controlled relays are adequately slugged or delayed. Note for example, capacitor C13 and resistor R12 connected across relay coil K10, such that one function is de-energized before the succeeding function is energized.

An important safety feature of the circuit is provided by the capacitor C14, (upper portion of FIG. 1) which functions to prevent catastrophic failure of the SCR inverters. If the button for relay K1 is opened and the KL coil is de-energized, then with the load open, capacitor C51 (FIG. 9) could discharge through the inverter 33 and destroy SCR3 and SCR4. Capacitor C51 is charged when relays K2 or K9 are energized. Should the operator de-energize relay K1 (open the button) during the boost mode, capacitor C14 discharges into the coil of relay K'H through CR11, and maintains the relay K'H energized and contacts K'H*c* closed (FIG. 9) for a period of time to thereby maintain a load on the transformer TR2 secondary during the time it takes capacitor C15 to charge. In other words, the foregoing maintains a high speed mode of operation until the charge is bled off capacitor C51 and the inverter is returned to its idle mode of operation at low power input.

Refer now to FIG. 5 which shows details of the 180 Hz. phase shift control network 21 and is similar to the circuit of the aforesaid Reissue Patent.

The base of transistor Q31 is connected to the phase shifted sinusoidal signal through coupling resistor R63 and a mid tap of the secondary 15*a*, of the input transformer 15. As described in the aforesaid Reissue Patent, the output of transistor Q31 is a square wave which is coupled to the base of transistor Q31 and the output of transistor Q32 is coupled to the base of transistor Q33. Accordingly, the outputs on leads 115 and 116 from the collectors of transistors Q32 and Q33, respectively, are always 180° out of phase with each other. These output signals each supply gate current drive to SCR1 and SCR2, respectively of the A.C. — to — D.C. Conversion Unit 27 of FIG. 9. In FIG. 5, capacitors C50 and C51 and resistors R60, R61 and R62 and the relay contacts K1*h* and K2*h* provide phase control means to provide a controlled sinusoidal phase shifted signal to transistor Q31. When the system is in quiescent or idle condition, nearly 180° of phase shift occurs so that the firing angles of SCR1 and SCR2 of A.D. — to — D.C, Conversion Unit 27 are nearly zero.

On closing of contacts K1*h* and K2*h*, the respective resistors R60 and R62 bridging these contacts are shorted out and the resulting phase shift then approaches 0° so that the firing angle of each of SCR1 and SCR2 are such as to sustain nearly 180° of conduction in each cycle. This is the boost condition, and will allow maximum current flow in the full wave A.C. — to — D.C. Conversion Unit 27 thereby charging the output capacitor 51 which is coupled to inverter 33.

Refer now to FIG. 8 which shows a circuit similar to that of the said Reissue Patent. Transistors Q34, Q35, Q36 and Q37 and their associated circuit components comprise oscillator and amplifier unit in control network 21 and are coupled to the inverter driver 29. Transistors Q34 and Q35 are connected in a conventional multivibrator circuit having a frequency of oscillation of 360 Hz. The signal output from transistors Q34 and Q35 is amplified and shaped by transistors Q36 and Q37. The output of transistor Q37 is a square wave with a sharp trailing edge which triggers a flip-flop circuit comprising transistors Q38 and Q39. Transistors Q38 and Q39 divide the 360 Hz. operating frequency to two to provide a 180 Hz. square wave. Note that this portion of the circuit is described in detail in the aforementioned Reissue Patent.

The outputs of transistors Q38 and Q39 are differentiated by the RC circuits labeled 79 and 80 and the differentiated pulses are amplified by transistors Q40, Q41, Q42 and Q43. In one embodiment, transistors Q42 and Q43 each supply 100 milliamperes to SCR3 and SCR4 respectively of the 180 Hz. SCR inverter 33 of FIG. 9, which pulses occur each 5.5 milliseconds, are 2.75 milliseconds apart and have a pulse duration of 200 microseconds.

FIG. 9 shows more of the details of the Conversion Unit 27, the inverter driver 29, the automatic start relay 31, the SCR inverter 33, filter 35, the selection relay contactors 37 and the rotor relay and separate phase capacitor network 39.

As mentioned above inverter 33 includes SCR3 and SCR4 connected to provide a conventional freerunning inverter commutated by a capacitor 23 which drives into the primary winding of an inverter transformer TR2.

The A.C. — to — D.C. Conversion Unit 27 and SCR bridge circuit charges capacitor C51 to a level determined by the phase angle of the gate drive to SCR1 and SCR2, and the longer the conduction period of SCR1 and SCR2, the higher capacitor 51 charges. Thus capacitor C51 is charged to provide a selected D.C. voltage in the slow speed conditions, and increased D.C. voltage during the run condition and a maximum D.C. voltage during acceleration or boost period. The boost voltage effectively provides an increased B+ supply to inverter 33.

Inverter 33 and transformer TR2 couple the output through an OTT filter 35 to the selection relay contactors 37 and the rotor relays and split phase capacitor network 39.

In low speed operation of the circuit, relay K'L is energized (FIG. 3); and contact K'L*b*, FIG. 9, will close. Accordingly, a signal is provided from a tap on the primary of transformer TR3 through contacts K'T*b*, K'L*b*, K'H*b* through current coil KZ, contact K'B*d* to lead 112 and contact K'A2 to the first or black lead of stator cord; and through contact K'H*f* and the split phase capacitor circuit 39 and current coil KX, contact K'B*b*, lead 111 and contact K'Al to the second or green lead of the stator cord; and, from lead 121 through contact K'L*c*, lead 113, contact K'A3 to the third or white lead of the stator cord.

Note that each of the stator cords can be connected separately to each of the three different tubes. That is, leads 111, 112 and 113 each are selectively connected by relay contacts to the stator cord of each tube.

During a high speed operation and during the acceleration or boost period relay K'H (FIG. 1) is energized as described above, while K'L is de-energized. This connects the output of the inverter 33 and transformer TR2 through filter 35, contact K'H*c*, current coil KZ, contact K'B*d* to lead 112 and contact K'A2 to the stator cord; and through split phase capacitor 39 and current coil KX, contact K'B*d*, lead 111 and contact K'Al to the stator cord; and, through contact K'L*d*, lead 113 and contact K'A3 to the stator cord.

During the braking cycle, relay coil K'B is energized to connect a D.C. signal 122 from D.C. brake bridge CR5 through contact K'B*a*, lead 111 and contact K'Al to the stator cord; and, through contact K'B*c*, lead 112 and contact K'A2 to the stator cord. The braking signal is a pulsating D.C. signal and is provided for 1.5 seconds after low speed operation and 4.5 seconds after high speed operation.

Relay K'S provides a means for automatically restarting the inverter 33 in the event a transient surge extinguishes the inverter similarly as in said Reissue Patent.

While the invention has been particularly shown and described with reference to a preferred embodiment thereof, it will be understood by those skilled in the art that various changes in form and details may be made therein without departing from the spirit and scope to the invention.

What is claimed is:

1. A system operable from an alternating current source for controllably providing power to an induction motor for driving rotating anodes of X-ray tubes; means for receiving the power at a line frequency and multiplying the line frequency; drive means for driving the motor and hence the anode; a phase shift network for selectively shifting the phase of the multiplied line frequency; said drive means being responsive to said phase shift network for selectively driving said motor at a first and at a second selected running speed and for accelerating said motor to the selected running speed dependent on the output of said phase shift network; and logic circuitry comprising first means for selectively connecting said phase shift network to select the X-ray tube anode to be rotated, second means for selecting the speed at which the anode is to be rotated, and acceleration timer means for controlling the length of time the drive means accelerates an anode dependent on the anode selected and the selected running speed.

2. A system as in claim 1 wherein said acceleration timer includes a first timing means comprising a semiconductor-threshold detector operable to first and second conductive states and having input terminals and output terminals, capacitor means connectable to obtain a time dependent charge thereon based on the tube selection, means for connecting said capacitor means to discharge at an input terminal of said detector, means for setting a conductive level of said detector whereby said detector remains in its first conducting state until said capacitor means discharges to a selected level, semiconductor switch means connected to the output terminal of said detector and rendered respectively conductive and non-conductive when said detector is in its first and second conductive states, and output means connected to said switch to be energized during the period said switch means is conducting.

3. A system as in claim 1 wherein said system includes a movable film transport, and means for performing X-Ray spot film exposures and wherein said logic control circuitry includes a film transport timing means for delaying the initiation of an X-Ray spot film exposure for a selected time, whereby prior to a spot film X-Ray exposure the unit transporting the film tends to be stationary and vibration due to movement to a new position is minimized before spot film X-Ray exposure.

4. A system as in claim 3 wherein said timing means include semiconductor threshold detector means, having first and second capacitor means connected to said detector means, resistor networks, said capacitor means connectable to be charged through a selected resistor network dependent on the tube selection, a resistor discharging network, means for connecting said capacitor means to discharge through said discharging network, voltage divider means for setting a conduction level of said detector whereby said detector remains in its first conducting state until said capacitor means discharge to a preset level, semiconductor switch means connected to the output terminal of said detector, said semiconductor switch means being rendered conductive by said detector during the first conducting state of said detector, and said semiconductor switch being rendered nonconductive or open when said detector changes to its second conducting state, relay means connected in the current circuit of said conductor switch to be energized during the period said semiconductor switch is conducting, and interlocking means for said drive means, said relay means connected to said interlocking means to enable said drive means only after a predetermined time.

5. A system as in claim 1 further including switching means for said drive means and for said logic circuitry comprising relays having coils and contacts, means connected across said relay coils to prevent energizing or closing a switch means until an associated switch means has been de-energized or opened.

6. A system as in claim 1 further including means for performing X-Ray spot film exposures and timing means for continuing the rotation of the selected anode for a discrete time period after an X-Ray spot film is exposed, said timing means including semiconductor threshold detector means having first and second conducting states, said detector having first and second input terminals and an output terminal, capacitor means, resistor networks, said capacitor means connectable to be charged through a selected resistor network dependent on the tube selection, a resistor discharging network, means to connect said capacitor means to discharge through said discharging network, said capacitor means connected to the first input terminal of said detector, voltage divider means connected to the second input terminal of said detector for setting a conduction level to said detector whereby said detector remains in its first conducting state until said capacitor means discharges to a preset level, semiconductor switch means connected to the output terminal in said detector, and semiconductor switch means being rendered conductive by said detector during the first conducting state of said detector, and said semiconductor switch being rendered non-conductive or open when said detector changes to its second conducting state, and relay means connected in the current circuit of said conductor switch to be energized during the period said semiconductor switch is conducting.

7. A system as in claim 1 wherein said drive means for the anode include an SCR inverter and a charging capacitor, and said logic control circuitry includes capacitor means connected to provide a voltage for a preselected period to said drive means upon opening of the electrical load comprising said anode whereby said charge capacitor is prevented from discharging through and damaging the SCR's in said inverter.

* * * * *